US010667968B2

(12) United States Patent
Ueda et al.

(10) Patent No.: US 10,667,968 B2
(45) Date of Patent: Jun. 2, 2020

(54) WHEELCHAIR

(71) Applicant: YOSIZUKA SEIKI CO., LTD., Fukuoka-shi, Fukuoka (JP)

(72) Inventors: Hidenori Ueda, Iizuka (JP); Masatsugu Takanabe, Iizuka (JP)

(73) Assignee: Yosizuka Seiki Co., Ltd. (JP)

( * ) Notice: Subject to any disclaimer, the term of this patent is extended or adjusted under 35 U.S.C. 154(b) by 0 days.

(21) Appl. No.: 16/340,573

(22) PCT Filed: Sep. 25, 2017

(86) PCT No.: PCT/JP2017/034601
§ 371 (c)(1),
(2) Date: Apr. 9, 2019

(87) PCT Pub. No.: WO2018/070233
PCT Pub. Date: Apr. 19, 2018

(65) Prior Publication Data

US 2019/0231618 A1 Aug. 1, 2019

(30) Foreign Application Priority Data

Oct. 11, 2016 (JP) ..... 2016-200467

(51) Int. Cl.
*A61G 1/02* (2006.01)
*A61G 5/08* (2006.01)

(52) U.S. Cl.
CPC ..... *A61G 5/0866* (2016.11); *A61G 1/02* (2013.01); *A61G 5/08* (2013.01)

(58) Field of Classification Search
CPC ..... A61G 5/0866; A61G 5/08; A61G 1/02
See application file for complete search history.

(56) References Cited

U.S. PATENT DOCUMENTS 4,736,960 A * 4/1988 Batty ..... A61G 5/08 280/250.1

FOREIGN PATENT DOCUMENTS

JP H07-112009 A 5/1995
JP 2009-028502 A 2/2009

* cited by examiner

*Primary Examiner* — Bryan A Evans
(74) *Attorney, Agent, or Firm* — Harness, Dickey & Pierce, P.L.C.

(57) ABSTRACT

A wheelchair includes right and left side frames and a connection unit connecting the side frames to each other. The side frames each include a unit fixture for detachably fixing the connection unit. The connection unit is selectable from a foldable connection unit connecting the right and left side frames with a distance therebetween changeable or a non-foldable connection unit connecting the right and left side frames with the distance therebetween kept constant.

3 Claims, 14 Drawing Sheets

WHEELCHAIR

The entire disclosure of Japanese Patent Application No. 2016-200467, filed on Oct. 11, 2016 is expressly incorporated by reference herein.

BACKGROUND

Technical Field

The present invention relates to a wheelchair excellent in applicability and versatility configured to be transformed between a folding wheelchair and a non-folding wheelchair by selecting and replacing parts, such that the wheelchair is usually used as the non-folding wheelchair suitable for, especially, disabled persons who commute to school or work, participate in social activities, and the like, while being transformed into the folding wheelchair as needed so that the wheelchair is compactly folded to be portable, the wheelchair thus eliminating the necessity of preparing two types of wheelchairs such as folding wheelchair and non-folding wheelchair.

Related Art

Typical wheelchairs are roughly categorized into two types such as folding wheelchairs and non-folding wheelchairs. For instance, for commuting to school or work and participating in social activities, non-folding wheelchairs are used due to superior robustness thereof.

Meanwhile, folding wheelchairs, which are easily portable, are used for, for instance, indoors (e.g., hospital) and traveling for a short distance from indoor to a vehicle.

Further, when a user goes to a distant place by vehicle, train, or the like, a wheelchair will be needed in the destination. In this case, a folding wheelchair is used, since a non-folding wheelchair is difficult to carry.

A typical folding wheelchair is exemplified by a wheelchair as disclosed in JP 7-112009 A, which includes right and left side frames and a seat support frame connecting the right and left side frames such that the right and left side frames are foldable.

The above typical techniques entail the following problems.

(1) A typical folding wheelchair as exemplified in JP 7-112009 A can be taken to a variety of places and easily used due to the light weight and easy foldability thereof, reducing the burden on a caregiver. However, such a wheelchair is not comfortable to sit in due to the poor rigidity and insufficient robustness thereof and thus not suitable for long-time use.

(2) Accordingly, while a non-folding wheelchair is favorably used for commuting to school or work, participating in social activities, and the like due to the superior robustness thereof, a folding wheelchair will need to be used if the non-folding wheelchair is difficult to take to a distant travel destination. Thus, two types of wheelchairs (i.e., folding wheelchair and non-folding wheelchair) need to be prepared in advance so that these wheelchairs are selectively used depending on, for instance, intended use, purpose, and place to use. This increases the burden on a user and/or a caregiver.

An object of the invention, which is intended to solve the above conventional problems, is to provide a wheelchair excellent in assembly/disassembly efficiency, maintenanceability, applicability, and versatility configured to be easily transformed between a folding wheelchair and a non-folding wheelchair by selecting and replacing parts, such that the wheelchair being usually used as the non-folding wheelchair suitable for, especially, disabled persons who commute to school or work, participate in social activities, and the like, while being transformed into the folding wheelchair as needed so that the wheelchair is compactly folded to be portable, the wheelchair thus eliminating the necessity of preparing two types of wheelchairs (i.e., folding wheelchair and non-folding wheelchair) and reducing the burden on a user and/or a caregiver.

SUMMARY

To solve the above problems, a wheelchair according to an aspect of the invention is configured as follows.

According to an aspect of the invention, a wheelchair includes: right and left side frames; and a connection unit connecting the side frames to each other. The side frames each include a unit fixture configured to detachably fix the connection unit, and the connection unit is selectable from a foldable connection unit configured to connect the right and left side frames with a distance therebetween changeable or a non-foldable connection unit configured to connect the right and left side frames with the distance therebetween kept constant.

The above arrangement achieves the following effects.

(1) Each side frame is provided with the unit fixture configured to detachably fix the connection unit. This arrangement allows for easily and reliably replacing the connection unit as needed with excellent assembly/disassembly efficiency and maintenanceability.

(2) The connection unit, which connects the right and left side frames to each other, is detachably fixed by the unit fixture. This arrangement allows for changing the width and form of the wheelchair by selectively combining one of the connection units with different dimensions and structures with excellent applicability and design flexibility.

(3) The right and left side frames and the connection unit are detachably connected and the connection unit is selectable from the foldable connection unit, which is configured to connect the right and left side frames with the distance therebetween changeable, or the non-foldable connection unit, which is configured to connect the right and left side frames with the distance therebetween kept constant. This arrangement allows the single wheelchair to be transformed as either a folding wheelchair or a non-folding wheelchair simply by changing the type of the connection unit depending on, for instance, travel distance and/or necessity of transportation with excellent applicability and multifunctionality. Additionally, since the side frames are used in common, inventory management is facilitated for excellent mass productivity.

(4) The connection unit connecting the right and left side frames to each other is detachable. This arrangement allows only a malfunctioning part to be easily replaced with excellent maintenanceability and resource-saving performance.

A material of the side frames and the connection unit is favorably a metal such as aluminum and magnesium.

A shape of the side frames may be selected as desired. However, when the side frames are in a frame shape, machinability and mass productivity are excellent. Further, the side frames can be reduced in weight with excellent transportability and handleability.

The shape and structure of the connection unit are selectable as desired as long as the connection unit is configured to detachably connect or fix the right and left side frames. Using a foldable connection unit configured to be foldable (capable of extension and retraction) in a width direction of the wheelchair by a link mechanism or the like, the wheelchair is easily folded to be stored or transported with excellent compactness and transportability. Meanwhile, using a non-foldable connection unit including a plurality of bar-shaped or pipe-shaped connecting members with opposite ends being connected to the right and left side frames, the right and left side frames are firmly fixed with excellent durability and robustness. It should be noted that the connecting members of the non-foldable connection unit may be in the form of a simple bar or, alternatively, may be connected in, for instance, H-shape, square U-shape, or square shape for reinforcement. The right and left side frames may be bridged by a reinforcing member to prevent deformation and/or torsion of the side frames as needed. In this case, opposite ends of the reinforcing member may be fitted in respective fitting recesses provided to the interior of the right and left side frames.

The unit fixture is not limited as long as the unit fixture is configured to detachably fix the connection unit. For instance, when a fixation hole (unit fixture) is drilled in each side frame while an attachment portion of the connection unit is female-threaded, each side frame and the connection unit are easily and firmly fixed by inserting a male screw (e.g., bolt) into the fixation hole from the outside of the side frame and screwing the male screw into the female thread with excellent attachment/detachment efficiency and fixation reliability.

A plurality of fixation holes or the like may be provided as the unit fixture to each side frame in accordance with attachment positions of the variety of connection units. In this case, the fixation holes or the like formed in accordance with the attachment positions of the connection units are selectively used for replacement of the connection units with excellent applicability and assembling flexibility. It should be noted that since parts other than the connection unit being attached to the side frames are configured to be fixed using a mechanism similar to the unit fixture, a plurality of unit fixtures may be formed in accordance with attachment positions of the variety of parts so that the variety of parts are selectively attached with excellent applicability and design flexibility.

A flip-up arm support (armrest) may be provided that is held rotatably around a horizontal axis. Such an arm support is rotated without projecting outward from the wheelchair with excellent space-saving properties and handleability. Additionally, when an assist handle is attached to an upper end of a rear frame where a backrest is attached, a caregiver can easily push the wheelchair with excellent operability.

When auxiliary wheels are attached near rear ends of the right and left side frames, and inside and behind the right and left wheels, the wheelchair can be effectively prevented from falling down with excellent safety. When the auxiliary wheels, which may be detachably held, are held rotatably within a horizontal plane around a vertical axis, the auxiliary wheels can be stored under the seat when unnecessary with excellent applicability.

In the above aspect, it is preferable that the foldable connection unit includes: a pair of link members crossed in an X-shape and rotatably connected by a pivot shaft at a longitudinal center thereof; a rotary shaft provided to a lower end of each of the link members; a shaft support detachably fixed to the unit fixture and configured to hold the rotary shaft such that the rotary shaft is rotatable; and a seat attachment provided to an upper end of each of the link members, and the side frames each include a seat support configured to support the seat attachment from below.

The above arrangement achieves the following effects in addition to the above effects of the invention.

(1) When the connection unit in use is the foldable connection unit, the wheelchair can be folded in the width direction as needed. The wheelchair thus exhibits excellent space-saving properties and storing properties when not in use. The wheelchair also exhibits excellent transportability and handleability, since the wheelchair can be easily transported by car or the like so that the wheelchair is used at the destination.

(2) The shaft support holding the rotary shaft, which is provided to the lower end of each link member of the foldable connection unit, such that the rotary shaft is rotatable is detachably fixed to the corresponding unit fixture. This arrangement allows for easy attachment and detachment of the side frames and the foldable connection unit, so that the foldable connection unit can be easily replaced with another connection unit as needed with excellent efficiency in replacing the connection unit, maintenanceability, and applicability.

(3) The shaft support of the foldable connection unit is detachably fixed to the corresponding unit fixture. Thus, after removal of the foldable connection unit, the interior of each side frame has no projection or the like with excellent handleability.

(4) The foldable connection unit includes: the pair of link members crossed in an X-shape and rotatably connected by the pivot shaft at the longitudinal center; the shaft support provided to the lower end of each link member and detachably fixed to the corresponding unit fixture; and the seat attachment provided to the upper end of each link member. The rotation of the pair of link members around the pivot shaft and the shaft support causes the right and left side frames to approach each other to be easily folded with excellent foldability.

(5) The side frames each include the seat support supporting the seat attachment from below, preventing the right and left side frames from being spaced more than a predetermined distance to reliably support the weight of the user sitting on a seat attached to the seat attachment with excellent form stability.

The shaft support, which is necessarily configured to hold the rotary shaft such that the rotary shaft is rotatable, may hold opposite ends of the rotary shaft. In this case, the rotary shaft is stably rotated, facilitating a folding operation with excellent motion stability and handleability.

A method of fixing the shaft support and the unit fixture can be selected as desired. However, these components are favorably screwed for excellent attachment/detachment efficiency and fixation stability.

The seat attachment is favorably detachably attached. It should be noted that the seat can be folded along with the foldable connection unit without being removed when the seat is made of cloth to have flexibility, whereas only the foldable connection unit is folded with the seat being removed, for instance, when the seat is in the form of cushion without flexibility or is hard and rigid.

In the above aspect, it is preferable that the foldable connection unit further includes an auxiliary link member with a first end rotatably supported by corresponding one of the side frames and a second end rotatably connected to corresponding one of the link members.

The above arrangement achieves the following effect in addition to the above effects of the invention.

(1) The foldable connection unit includes the auxiliary link member with the first end rotatably connected to the corresponding side frame and the second end rotatably connected to the corresponding link member. Since the auxiliary link member supports the link member, form stability is excellent. Further, since the weight of the user applied to the seat is dispersed to be reliably supported, safety and durability are excellent.

The first end of the auxiliary link member is rotatably supported by the corresponding side frame while the second end is rotatably connected to the corresponding link member. In this regard, when the shaft support for the first end of the auxiliary link member is detachable from the corresponding side frame, the auxiliary link member and the link member can be handled as a one-piece component and thus easily attached and detached as the foldable connection unit.

It should be noted that a method of fixing the shaft support for the first end of the auxiliary link member may be selected as desired. However, when a fixation hole or the like is provided as the unit fixture to each side frame in accordance with the attachment position of the shaft support while the shaft support is female-threaded, the shaft support can be easily attached and detached by screwing in the same manner as the shaft support for each link member.

In the above aspect, it is preferable that the non-foldable connection unit includes a plurality of connecting members each having opposite ends configured to be detachably fixed to the unit fixture of the right side frame and the unit fixture of the left side frame, and a seat mounting member is detachably provided to each of the side frames.

The above arrangement achieves the following effects in addition to the above effects of the invention.

(1) When the connection unit in use is the non-foldable connection unit including the plurality of connecting members with the opposite ends detachably fixed to the unit fixture of the right side frame and the unit fixture of the left side frame, the rigidity of the wheelchair is enhanced as a whole. The wheelchair is thus used as a non-folding wheelchair with excellent form stability and robustness.

(2) When the wheelchair is not going to be transported by car or the like but continuously used for a long time, the non-foldable connection unit is used to connect the right and left side frames with the seat mounting member attached to each side frame so that the wheelchair is comfortable to sit in with less burden on the user. The wheelchair can thus be suitably used for, for instance, commuting to school or work and participating in social activities.

(3) The seat mounting member is detachably provided to each side frame. To use the foldable connection unit, which is integral with the seat attachment or the like in place of the non-foldable connection unit, the foldable connection unit or the like is attached with the unnecessary seat mounting members removed with excellent applicability.

The connecting members may be solid or hollow as long as the connecting members have a predetermined length and, the number, location and the like thereof may be selected as desired. The opposite ends of the connecting members are each fixed to the unit fixture of the corresponding side frame. In this regard, the connecting members are preferably fixed by screwing for excellent attachment/detachment efficiency and fixation reliability. When a plurality of fixation holes are provided as the unit fixture to each side frame in accordance with the attachment positions of the connecting members, the connecting members, each of which has the female-threaded opposite ends, are easily fixed by screwing. It should be noted that the connecting members may be in the form of a hollow pipe to reduce the weight thereof. In this case, a female-threaded member substantially in a columnar shape may be fitted on each of the opposite ends of the connecting members.

The seat mounting member is not limited as long as the seat mounting member can support the seat. At least two pole or pipe members, which are fixed along the interior of the right and left side frames to mount the seat, may be in, for instance, H-shape, square U-shape, or square shape.

The seat mounting member is detachable from each side frame. In this regard, when a support configured to support the seat mounting member from below is provided to the interior of each side frame, the seat mounting member is supported by the support while being restrained from movement (displacement) in a right-left direction by the side frames. It should be noted that when the support is in L-shape or square U-shape, the seat mounting member is held at a predetermined position to be reliably prevented from movement in the right-left direction. When each side frame is provided with front and rear abutment portions configured to come into contact with front and rear ends of the seat mounting member, the movement of the seat mounting member in a front-rear direction is also prevented with excellent fixation stability and attachment/detachment efficiency of the seat mounting member. In this regard, a seat retainer including the support and the abutment portions in the form of a one-piece component may be attached to each side frame. Alternatively, a seat retainer with a fitting recess where each end of the seat mounting member is to be fitted may be used.

DETAILED DESCRIPTION

Wheelchairs according to exemplary embodiments of the invention will be described with reference to drawings. It should be noted that the technical scope of the invention is by no means limited to these exemplary embodiments.

First Exemplary Embodiment

Figure 1:
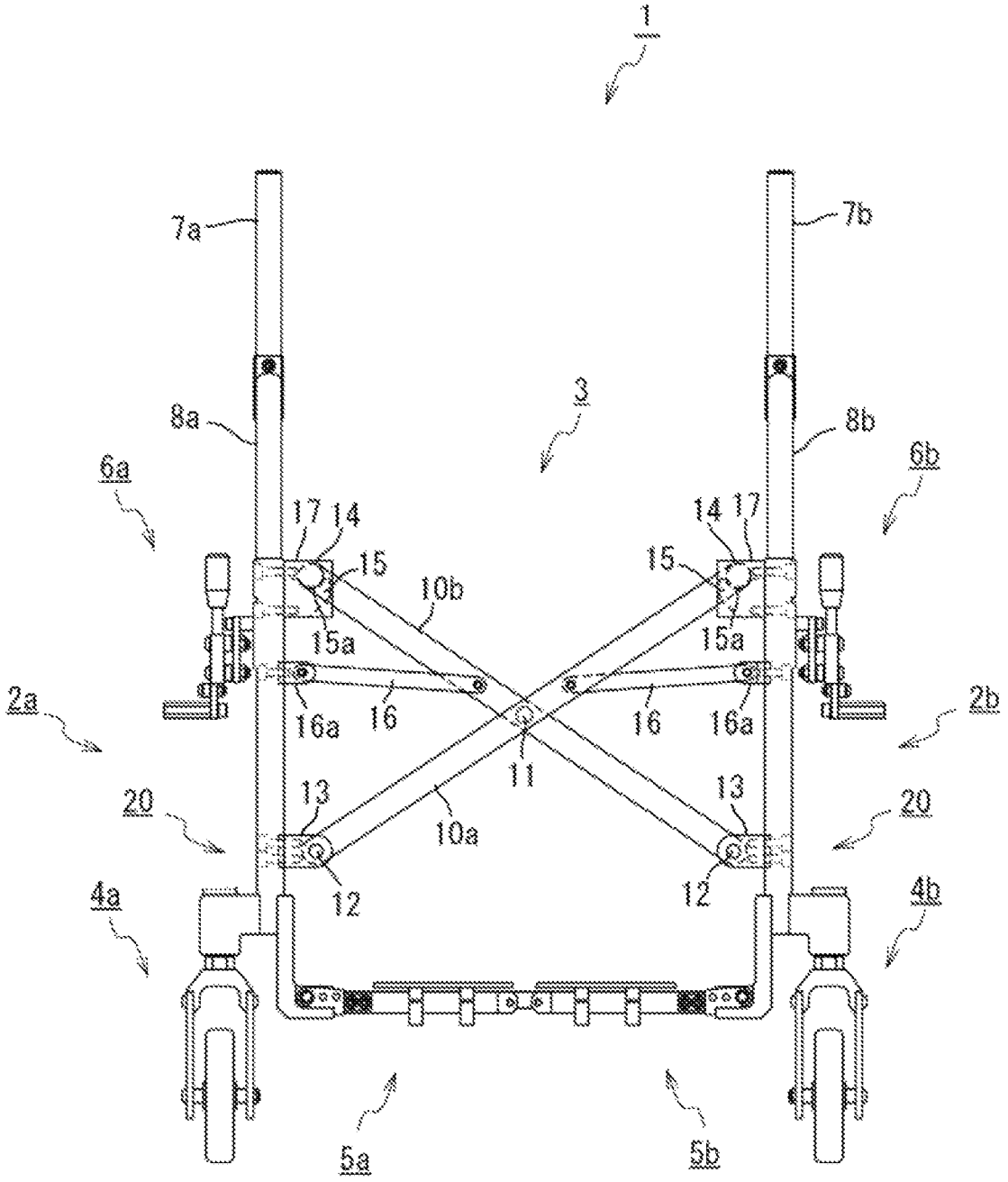
FIG. 1 is a schematic front view of a relevant part showing a first use form of a wheelchair according to a first exemplary embodiment.
Figure 2:
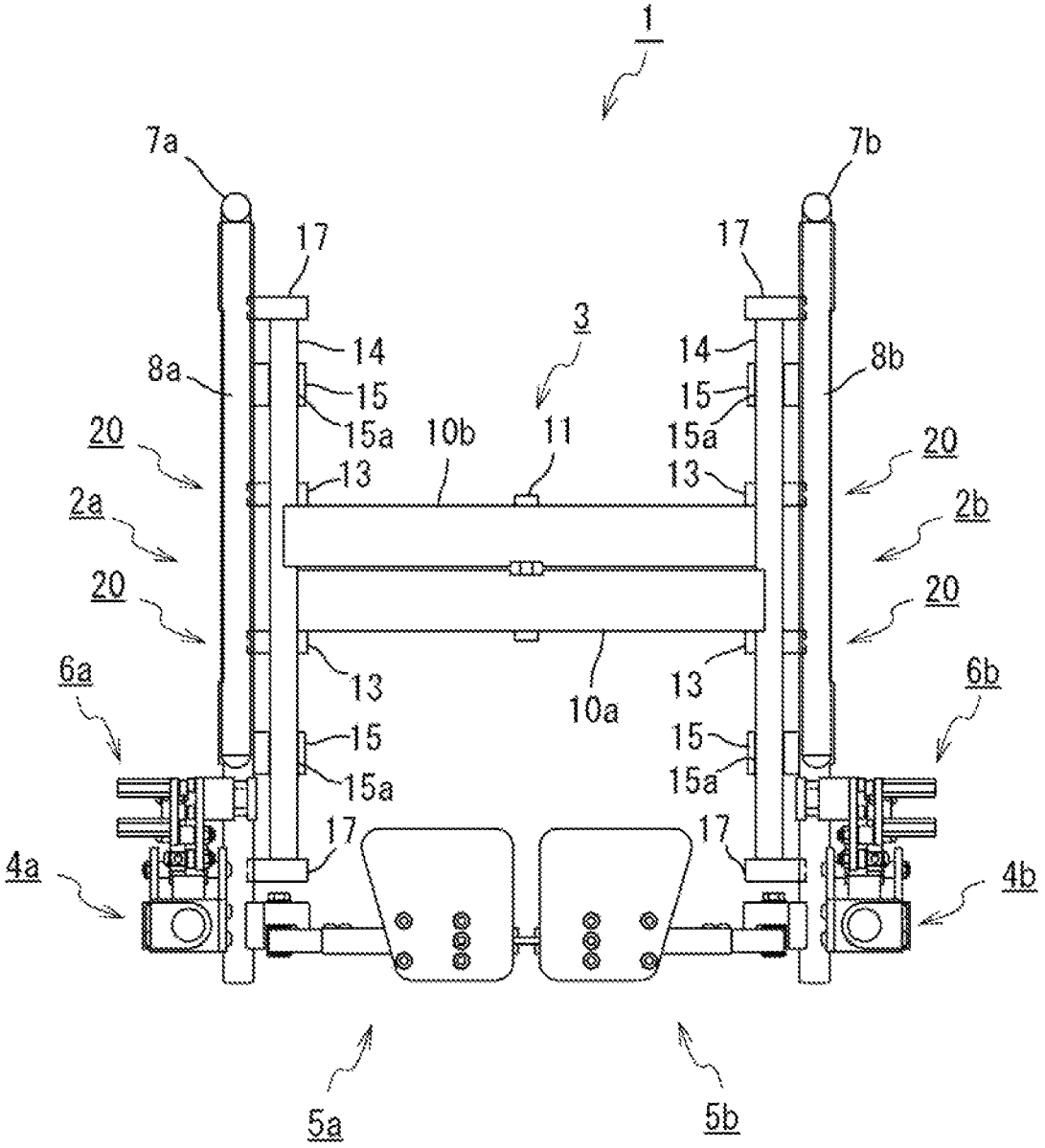
FIG. 2 is a schematic plan view of a relevant part showing the first use form of the wheelchair according to the first exemplary embodiment.
Figure 3:
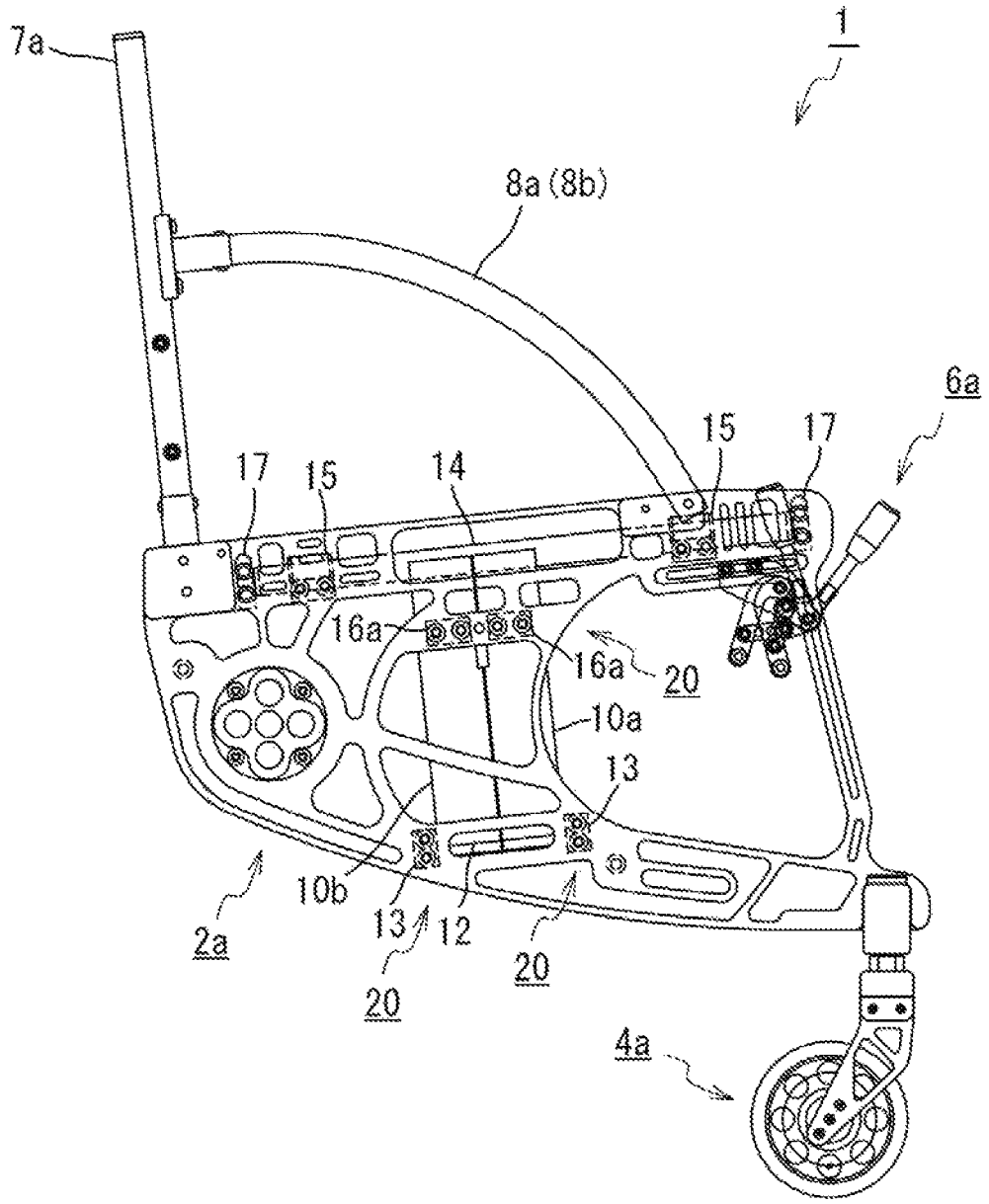
FIG. 3 is a schematic side view of a relevant part showing the first use form of the wheelchair according to the first exemplary embodiment.

FIG. 1 is a schematic front view of a relevant part showing a first use form of a wheelchair according to a first exemplary embodiment. FIG. 2 is a schematic plan view of a relevant part showing the first use form of the wheelchair according to the first exemplary embodiment. FIG. 3 is a schematic side view of a relevant part showing the first use form of the wheelchair according to the first exemplary embodiment. It should be noted that right and left wheels, seat, and backrest are not illustrated for the convenience of explanation.

Referring to FIGS. 1 and 2, a wheelchair 1 according to the first exemplary embodiment includes: right and left side frames 2*a*, 2*b* made of a metal such as aluminum and magnesium; a foldable connection unit 3 made of a metal such as aluminum and magnesium and connecting the side frames 2*a*, 2*b* to each other such that the side frames 2*a*, 2*b* are detachable; front wheels 4*a*, 4*b* located at lower front portions of the side frames 2*a*, 2*b*, the front wheels 4*a*, 4*b* being turnable; footrests 5*a*, 5*b* located at the lower front portions of the side frames 2*a*, 2*b*, the footrests 5*a*, 5*b* being foldable; brakes 6*a*, 6*b* located at upper front portions of the side frames 2*a*, 2*b*; rear frames 7*a*, 7*b* located vertically at rear ends of the side frames 2*a*, 2*b*, a backrest being attached to the rear frames 7*a*, 7*b*; a pair of link members 10*a*, 10*b* of the foldable connection unit 3 crossed in an X-shape and rotatably connected by a pivot shaft 11 at a longitudinal center; a rotary shaft 12 provided to a lower end of each of the link members 10*a*, 10*b*; a shaft support 13 detachably fixed to an interior of each of the side frames 2*a*, 2*b* and holding the corresponding rotary shaft 12 such that the rotary shaft 12 is rotatable; a seat attachment 14 provided to an upper end of each of the link members 10*a*, 10*b*; and a seat support 15 detachably provided on the interior of each of the side frames 2*a*, 2*b* and supporting the corresponding seat attachment 14 from below at an arc-shaped recess 15*a* thereof.

Referring to FIGS. 1 and 3, an auxiliary link member 16 has a first end rotatably supported by a shaft support 16*a* detachably fixed to the interior of each of the side frames 2*a*, 2*b* and a second end rotatably connected to corresponding one of the link members 10*a*, 10*b* between the pivot shaft 11 and the seat attachment 14.

Referring to FIGS. 2 and 3, arc-shaped connecting frames 8*a*, 8*b* connect rear frames 7*a*, 7*b* to upper front portions of the side frames 2*a*, 2*b*, and front and rear abutment portions 17 are detachably provided on the interior of an upper portion of each of the side frames 2*a*, 2*b*, the front and rear abutment portions 17 being configured to come into contact with front and rear ends of the seat attachment 14 to restrict a movement of the seat attachment 14 in a front-back direction.

Next, a description will be made on a unit fixture for fixing the foldable connection unit, which is used for the first use form of the wheelchair according to the first exemplary embodiment, to each side frame.

Figure 4:
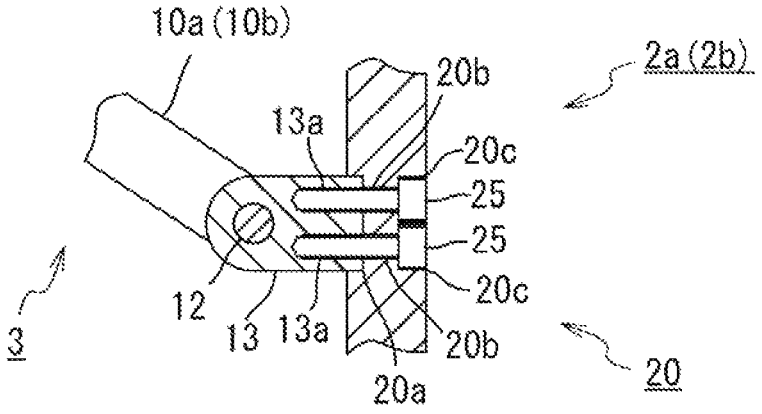
FIG. 4 is a schematic enlarged cross-sectional view of a relevant part showing an attachment state of a shaft support of a foldable connection unit used for the first use form of the wheelchair according to the first exemplary embodiment.

FIG. 4 is a schematic enlarged cross-sectional view of a relevant part showing an attachment state of the shaft support of the foldable connection unit used for the first use form of the wheelchair according to the first exemplary embodiment.

Referring to FIG. 4, two upper and lower female threads 13*a* are provided to each shaft support 13 of the foldable connection unit 3, and a unit fixture 20 for detachably fixing the foldable connection unit 3 is provided to each of the side frames 2*a*, 2*b*. The unit fixture 20 includes: a fitting recess 20*a* where an end of the shaft support 13 is fitted, the fitting recess 20*a* being provided to the interior of each of the side frames 2*a*, 2*b*; a fixation hole 20*b* penetrating through each of the side frames 2*a*, 2*b* to receive a shaft of a male screw 25 screwed into each female thread 13*a* of the shaft support 13; and a countersink 20*c* provided to an exterior of each of the side frames 2*a*, 2*b* to receive a head of the male screw 25.

When the fixation hole 20*b* (unit fixture 20) or the like is provided to each of the side frames 2*a*, 2*b* at a position corresponding to an attachment position of the foldable connection unit 3 as described above, the side frames 2*a*, 2*b* are easily and firmly fixed to the foldable connection unit 3. In particular, as shown in FIG. 4, the fitting recess 20*a* configured to reliably hold the shaft support 13 prevents positional displacement and/or inclination with excellent form stability. Additionally, the countersink 20c prevents the head of the male screw 25 from projecting out of each of the side frames 2*a*, 2*b* with excellent safety.

It should be noted that a variety of parts (units), such as the seat support 15, the shaft support 16*a* (see FIG. 1), and the abutment portions 17 (see FIG. 3), are configured to be detachably fixed to the interior of each of the side frames 2*a*, 2*b* using a mechanism similar to the unit fixtures 20.

A description will be made on how to use the above wheelchair in the first use form according to the first exemplary embodiment.

Figure 5:
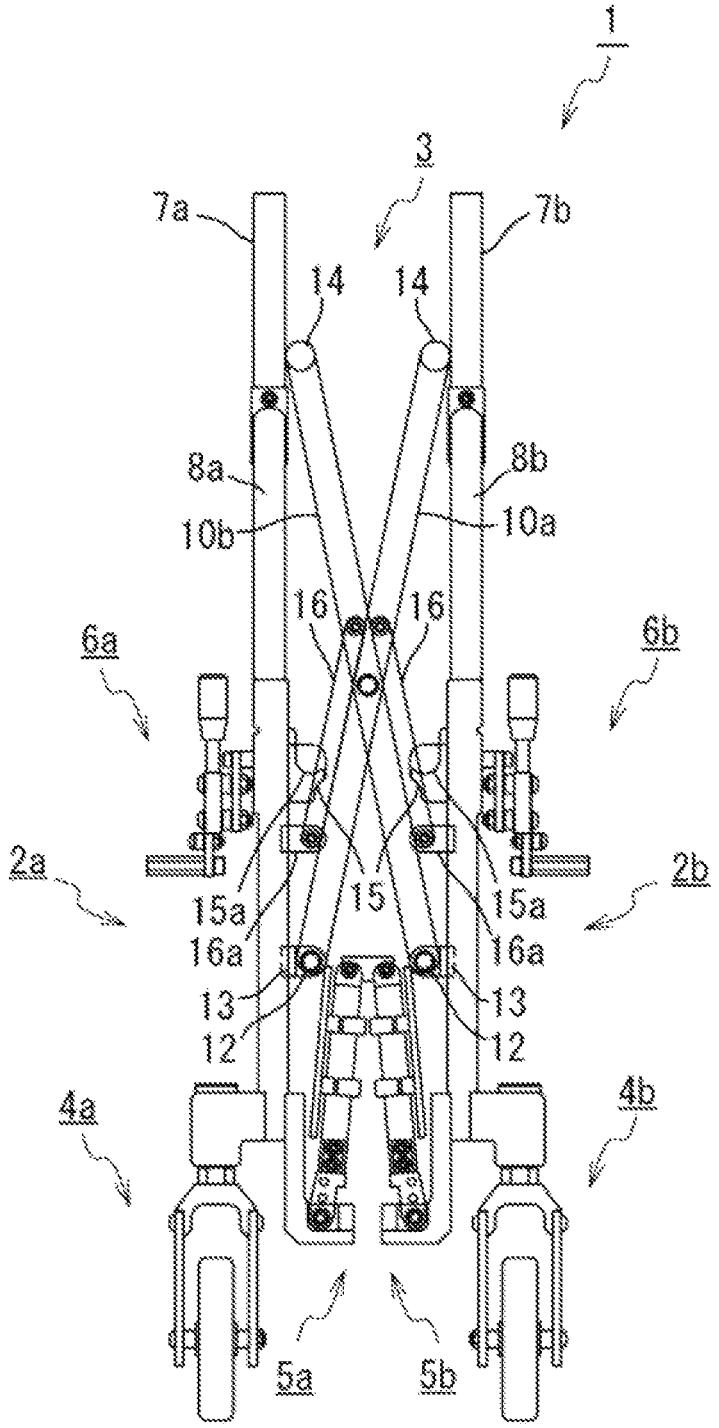
FIG. 5 is a schematic front view of a relevant part showing a folded state of the wheelchair in the first use form according to the first exemplary embodiment.

FIG. 5 is a schematic front view of a relevant part showing a folded state of the wheelchair in the first use form according to the first exemplary embodiment.

When the wheelchair 1 is in the first use form, the right and left side frames 2*a*, 2*b* are each connected to the foldable connection unit 3, which is configured to be foldable by the pair of link members 10*a*, 10*b*. The wheelchair 1 can thus be folded in a width direction as shown in FIG. 5 as needed when the wheelchair 1 is not in use or transported by car or the like. In particular, the wheelchair 1 can be easily used for, for instance, traveling indoors (e.g., hospital) and traveling for a short distance from indoor to a vehicle.

Next, a description will be made on a second use form of the wheelchair according to the first exemplary embodiment.

Figure 6:
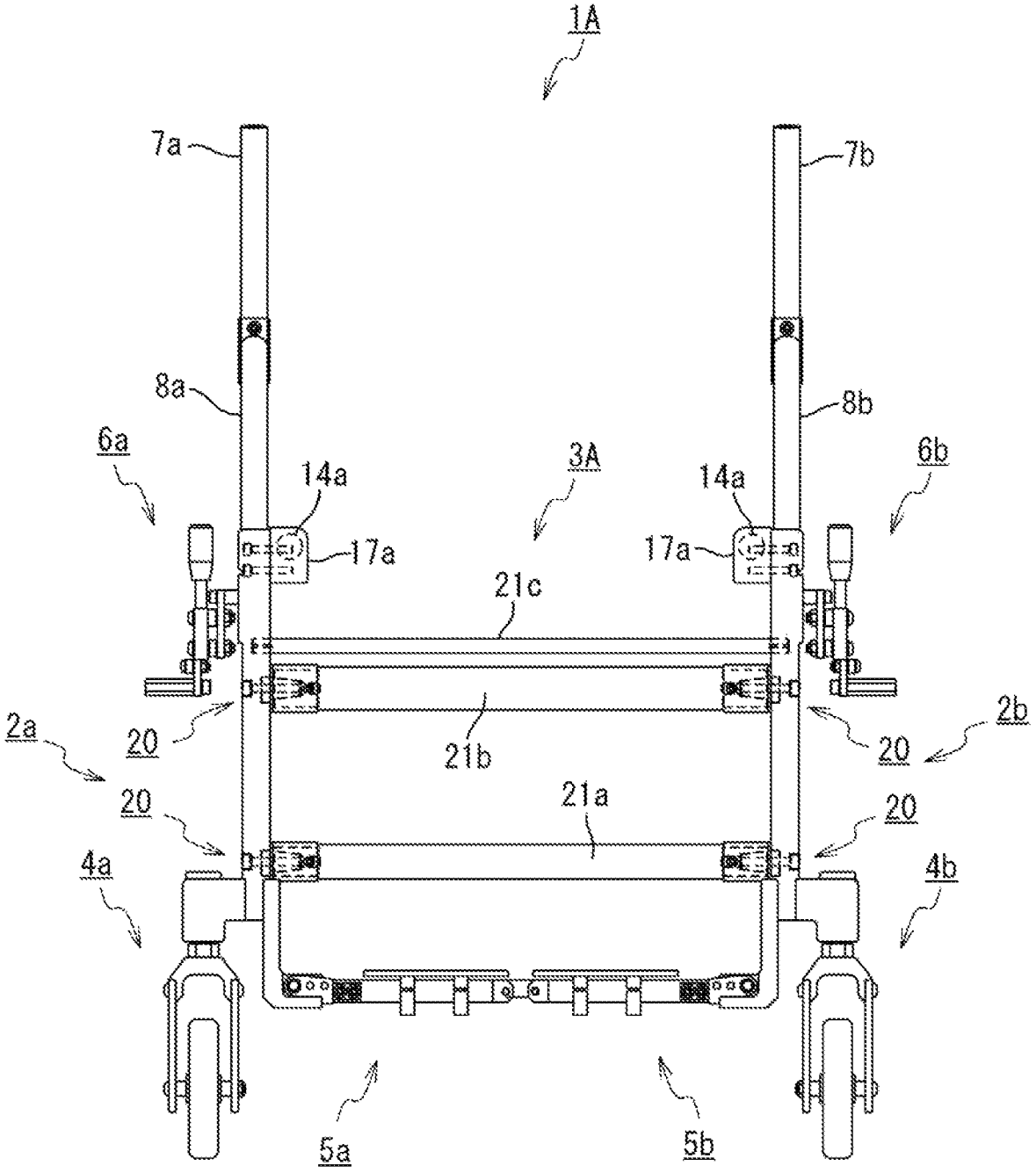
FIG. 6 is a schematic front view of a relevant part showing a second use form of the wheelchair according to the first exemplary embodiment.
Figure 7:
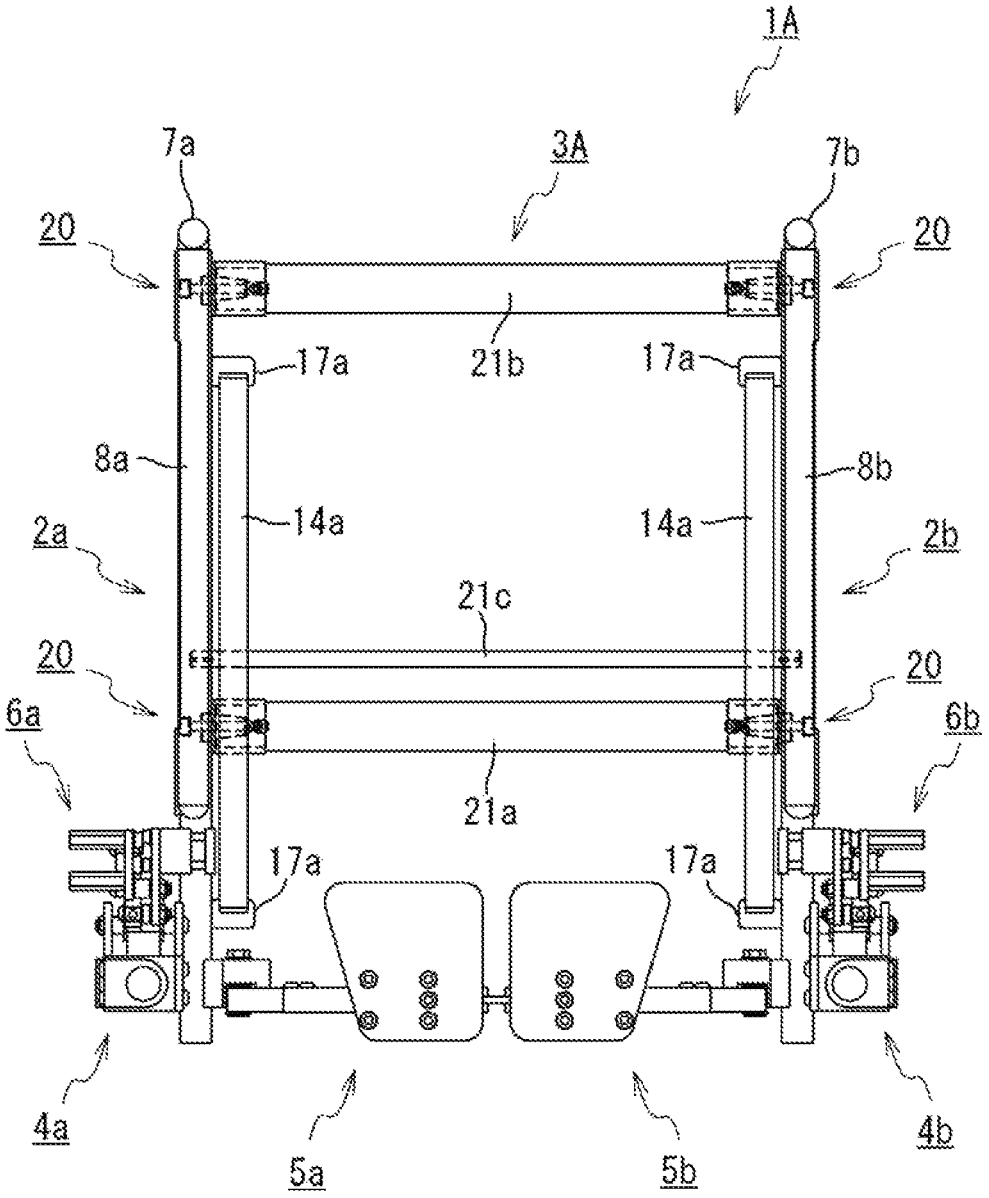
FIG. 7 is a schematic plan view of a relevant part showing the second use form of the wheelchair according to the first exemplary embodiment.
Figure 8:
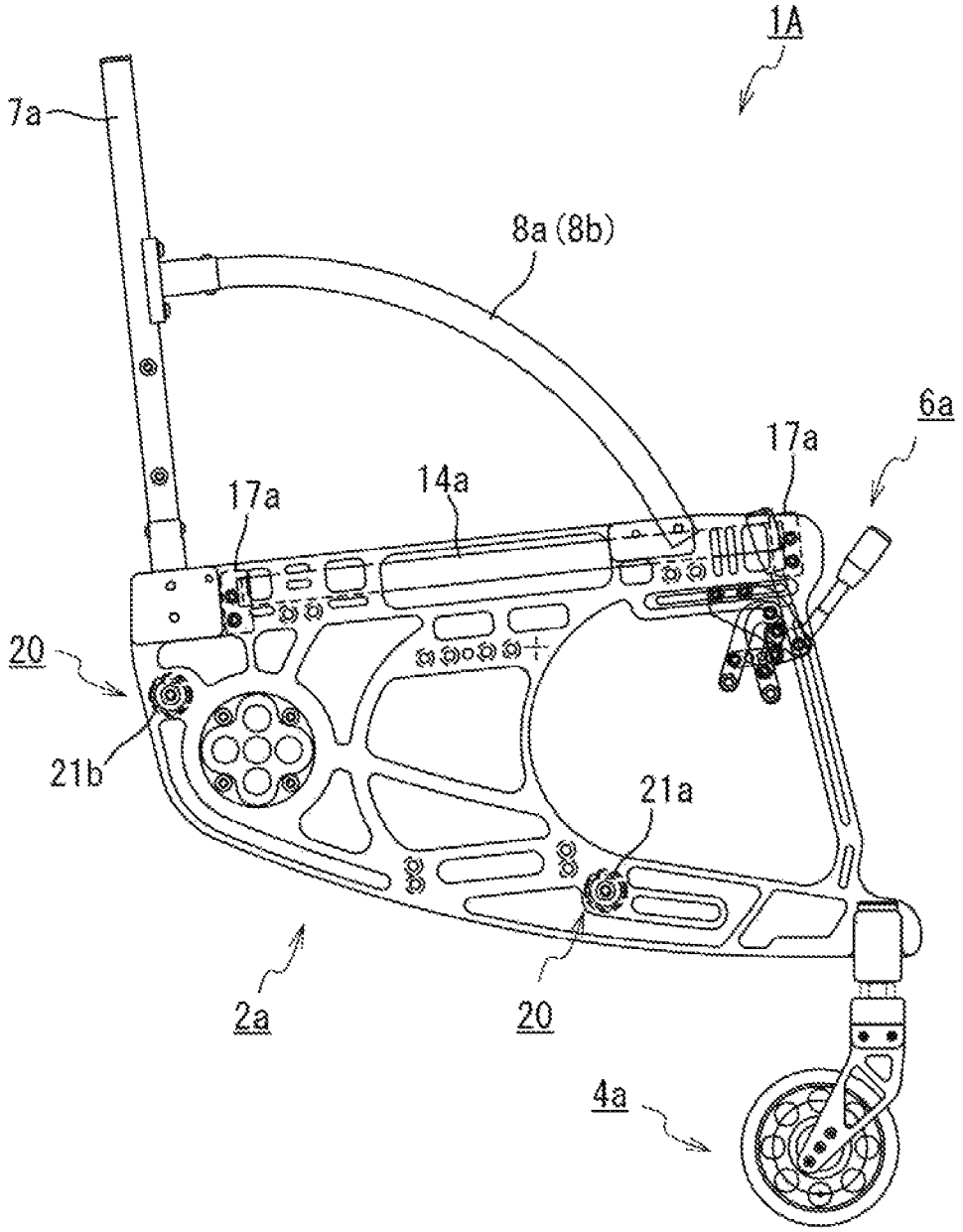
FIG. 8 is a schematic side view of a relevant part showing the second use form of the wheelchair according to the first exemplary embodiment.

FIG. 6 is a schematic front view of a relevant part showing the second use form of the wheelchair according to the first exemplary embodiment. FIG. 7 is a schematic plan view of a relevant part showing the second use form of the wheelchair according to the first exemplary embodiment. FIG. 8 is a schematic side view of a relevant part showing the second use form of the wheelchair according to the first exemplary embodiment.

Referring to FIGS. 6 to 8, a wheelchair 1A in the second use form is different from one in the first use form in that a non-foldable connection unit 3A is used as the connection unit in place of the foldable connection unit 3, the non-foldable connection unit 3A including a plurality of connecting members 21*a*, 21*b* with opposite ends that are detachably fixed to the unit fixture 20 of the right side frame 2*a* and the unit fixture 20 of the left side frame 2*b*.

It should be noted that referring to FIGS. 6 to 8, a seat mounting member 14*a* is located at an upper portion of the interior of each of the side frames 2*a*, 2*b* with opposite ends thereof held by front and rear seat retainers 17*a* detachably provided to the upper portion of the interior of each of the side frames 2*a*, 2*b*, and a bar-shaped reinforcing member 21*c* bridges the right and left side frames 2*a*, 2*b* with opposite ends thereof fitted in respective fitting recesses provided to the interior of the side frames 2*a*, 2*b*.

With the above-described unit fixture 20 formed at a predetermined position in each of the side frames 2*a*, 2*b* corresponding to the attachment position of each of the connecting members 21*a*, 21*b* of the non-foldable connection unit 3A, each of the side frames 2*a*, 2*b* and the non-foldable connection unit 3A are easily and reliably connected to each other by screwing the opposite ends of each of the connecting members 21*a*, 21*b*. Additionally, the seat retainers 17*a* are configured to be detachably fixed to the interior of the side frames 2*a*, 2*b* using a mechanism similar to the unit fixtures 20. It should be noted that a reinforcing member 21*c* may be attached to prevent deformation and/or torsion of the side frames 2*a*, 2*b* as needed and the number and the location of the reinforcing member(s) 21 may be selected as desired.

The wheelchair 1A in the second use form according to the first exemplary embodiment as described above, in which the right and left side frames 2*a*, 2*b* are connected by the non-foldable connection unit 3A including the plurality of connecting members 21*a*, 21*b* with a constant length, is excellent in form stability and robustness and thus suitably usable for, for instance, commuting to school or work and participating in social activities without increasing the burden on the user even during a long-time continuous use.

The side frames 2*a*, 2*b* are each provided in advance with the unit fixture 20 for attaching each of a variety of parts including the connection units and others. This allows the variety of parts including the connection units and others to be easily and reliably fixed and to be selectively combined to enable a plurality of use forms with excellent applicability and design flexibility.

It should be noted that although the seat retainers 17*a* hold the opposite ends of the seat mounting member 14*a* in the second use form, the seat support 15 and the abutment portions 17 may be used in place of the seat retainers 17*a* as long as the seat mounting member 14*a* is the same in diameter and length as the seat attachment 14 of the foldable connection unit 3 for the first use form.

The wheelchair according to the first exemplary embodiment achieves the following effects.

(1) Each side frame is provided with the unit fixture configured to detachably fix the connection unit. This arrangement allows for easily and reliably replacing the connection unit as needed with excellent assembly/disassembly efficiency and maintenanceability.

(2) The connection unit, which connects the right and left side frames to each other, is detachably fixed by the unit fixture. This arrangement allows for changing the width and form of the wheelchair by selectively combining one of the connection units with different dimensions and structures with excellent applicability and design flexibility.

(3) The right and left side frames and the connection unit are detachably connected and the connection unit is selectable from the foldable connection unit, which is configured to connect the right and left side frames with the distance therebetween changeable, or the non-foldable connection unit, which is configured to connect the right and left side frames with the distance therebetween kept constant. This arrangement allows the single wheelchair to be transformed as either a folding wheelchair or a non-folding wheelchair simply by changing the type of the connection unit depending on, for instance, travel distance and/or necessity of transportation with excellent applicability and multifunctionality. Additionally, since the side frames are used in common, inventory management is facilitated for excellent mass productivity.

(4) The connection unit configured to connect the right and left side frames to each other is detachable. This arrangement allows only a malfunctioning part to be easily replaced with excellent maintenanceability and resource-saving performance.

(5) When the connection unit in use is the foldable connection unit, the wheelchair can be folded in the width direction as needed. The wheelchair thus exhibits excellent space-saving properties and storing properties when not in use. The wheelchair also exhibits excellent transportability and handleability, since the wheelchair can be easily transported by car or the like so that the wheelchair is used at the destination.

(6) The shaft support holding the rotary shaft, which is provided to the lower end of each link member of the foldable connection unit, such that the rotary shaft is rotatable is detachably fixed to the corresponding unit fixture. This arrangement allows for easy attachment and detachment of the side frames and the foldable connection unit, so that the foldable connection unit can be easily replaced with another connection unit as needed with excellent efficiency in replacing the connection unit, maintenanceability, and applicability.

(7) The shaft support of the foldable connection unit is detachably fixed to the unit fixture. Thus, after removal of the foldable connection unit, the interior of each side frame has no projection or the like with excellent handleability.

(8) The foldable connection unit includes: the pair of link members crossed in an X-shape and rotatably connected by the pivot shaft at the longitudinal center; the shaft support provided to the lower end of each link member and detachably fixed to the corresponding unit fixture; and the seat attachment provided to the upper end of each link member. The rotation of the pair of link members around the pivot shaft and the shaft support causes the right and left side frames to approach each other to be easily folded with excellent foldability.

(9) The side frames each include the seat support supporting the seat attachment from below, preventing the right and left side frames from being spaced more than a predetermined distance to reliably support the weight of the user sitting on a seat attached to the seat attachment with excellent form stability.

(10) The foldable connection unit includes the auxiliary link member with the first end rotatably connected to the corresponding side frame and the second end rotatably connected to the corresponding link member. Since the auxiliary link member supports the link member, form stability is excellent. Further, since the weight of the user applied to the seat is dispersed to be reliably supported, safety and durability are excellent.

(11) When the connection unit in use is the non-foldable connection unit including the plurality of connecting members with the opposite ends detachably fixed to the unit fixture of the right side frame and the unit fixture of the left side frame, the rigidity of the wheelchair is enhanced as a whole. The wheelchair is thus used as a non-folding wheelchair with excellent form stability and robustness.

(12) When the wheelchair is not going to be transported by car or the like but continuously used for a long time, the non-foldable connection unit is used to connect the right and left side frames with the seat mounting member attached to each side frame so that the wheelchair is comfortable to sit in with less burden on the user. The wheelchair can thus be suitably used for, for instance, commuting to school or work and participating in social activities.

(13) The seat mounting member is detachably provided to each side frame. To use the foldable connection unit, which is integral with the seat attachment or the like in place of the non-foldable connection unit, the foldable connection unit or the like is attached with the unnecessary seat mounting member removed with excellent applicability.

Second Exemplary Embodiment

Next, a wheelchair according to a second exemplary embodiment will be described. A basic configuration of the wheelchair according to the second exemplary embodiment is the same as that of the wheelchair according to the first exemplary embodiment. Accordingly, a description of the common configuration is omitted but different parts will be described below.

Figure 9:
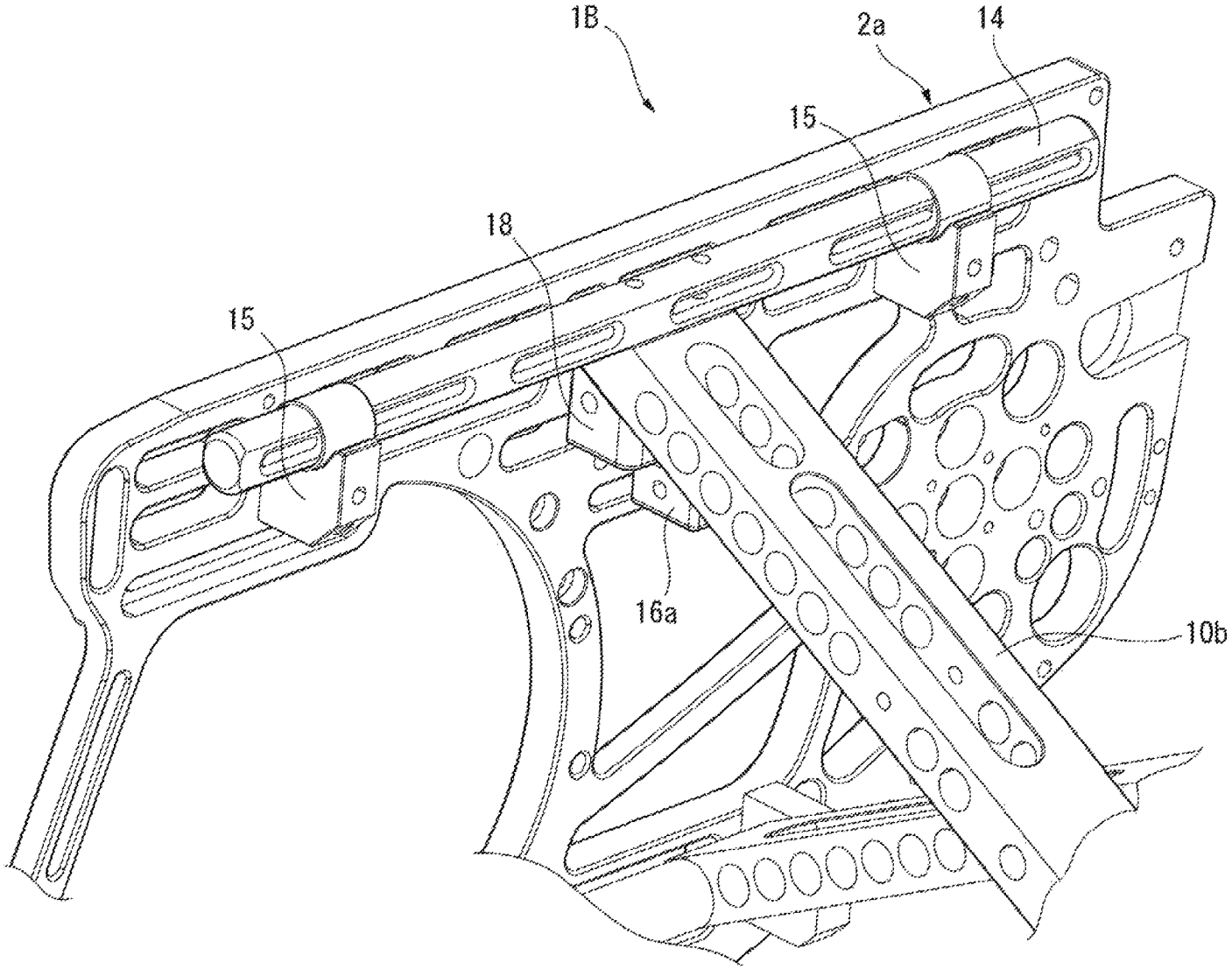
FIG. 9 is a perspective view showing a wheelchair in a first use form according to a second exemplary embodiment with a seat attachment being supported by a seat support.
Figure 10:
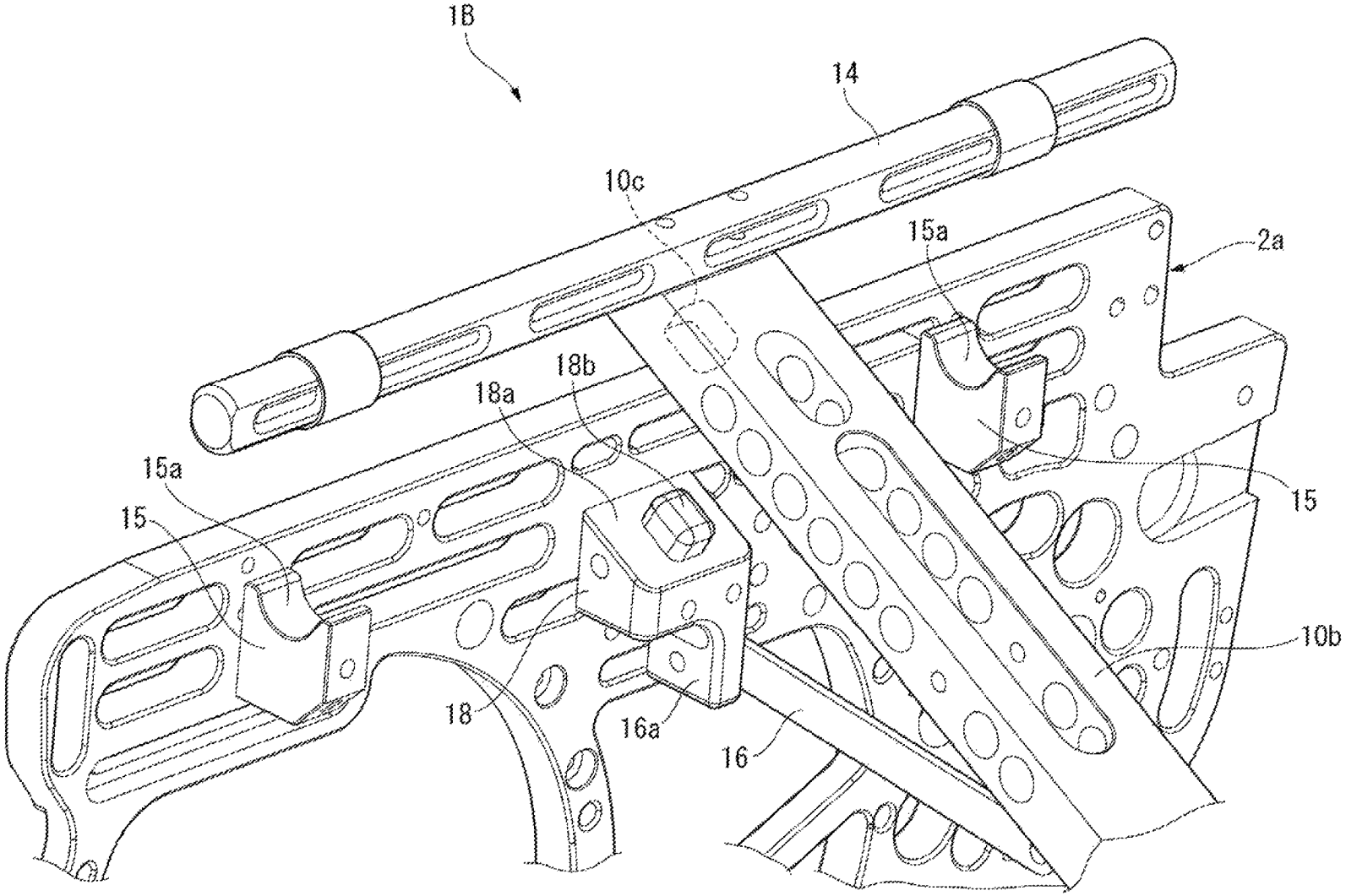
FIG. 10 is a perspective view showing the wheelchair in the first use form according to the second exemplary embodiment with the seat attachment being separated from the seat support.
Figure 11:
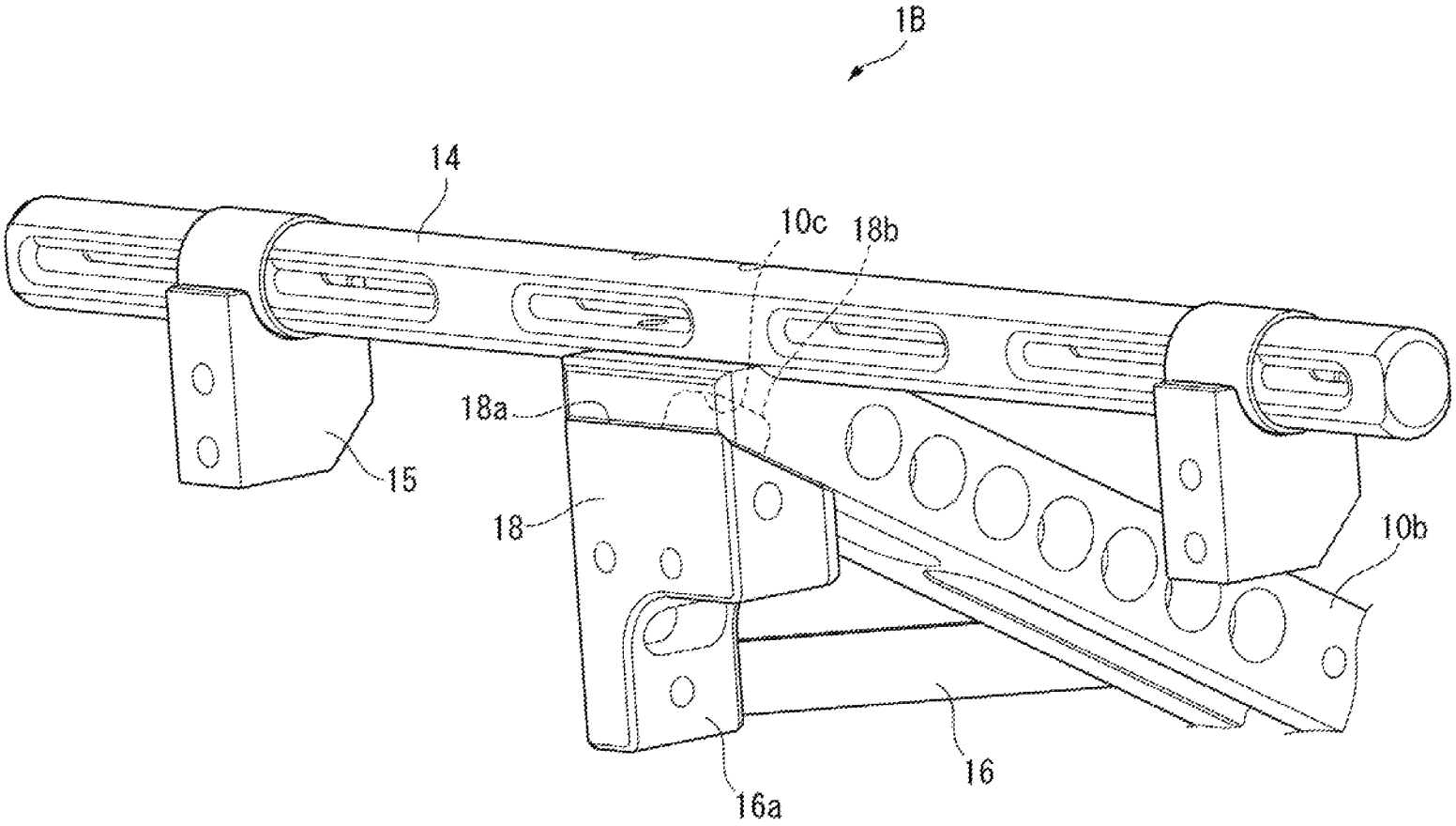
FIG. 11 is a perspective view showing the wheelchair in the first use form according to the second exemplary embodiment with the seat attachment being supported by the seat support as viewed from a different direction.

FIG. 9 is a perspective view showing the wheelchair in a first use form according to the second exemplary embodiment with a seat attachment being supported by a seat support. FIG. 10 is a perspective view showing the wheelchair in the first use form according to the second exemplary embodiment with the seat attachment separated from the seat support. FIG. 11 is a perspective view showing the wheelchair in the first use form according to the second exemplary embodiment with the seat attachment supported by the seat support as viewed from a different direction.

Figure 12:
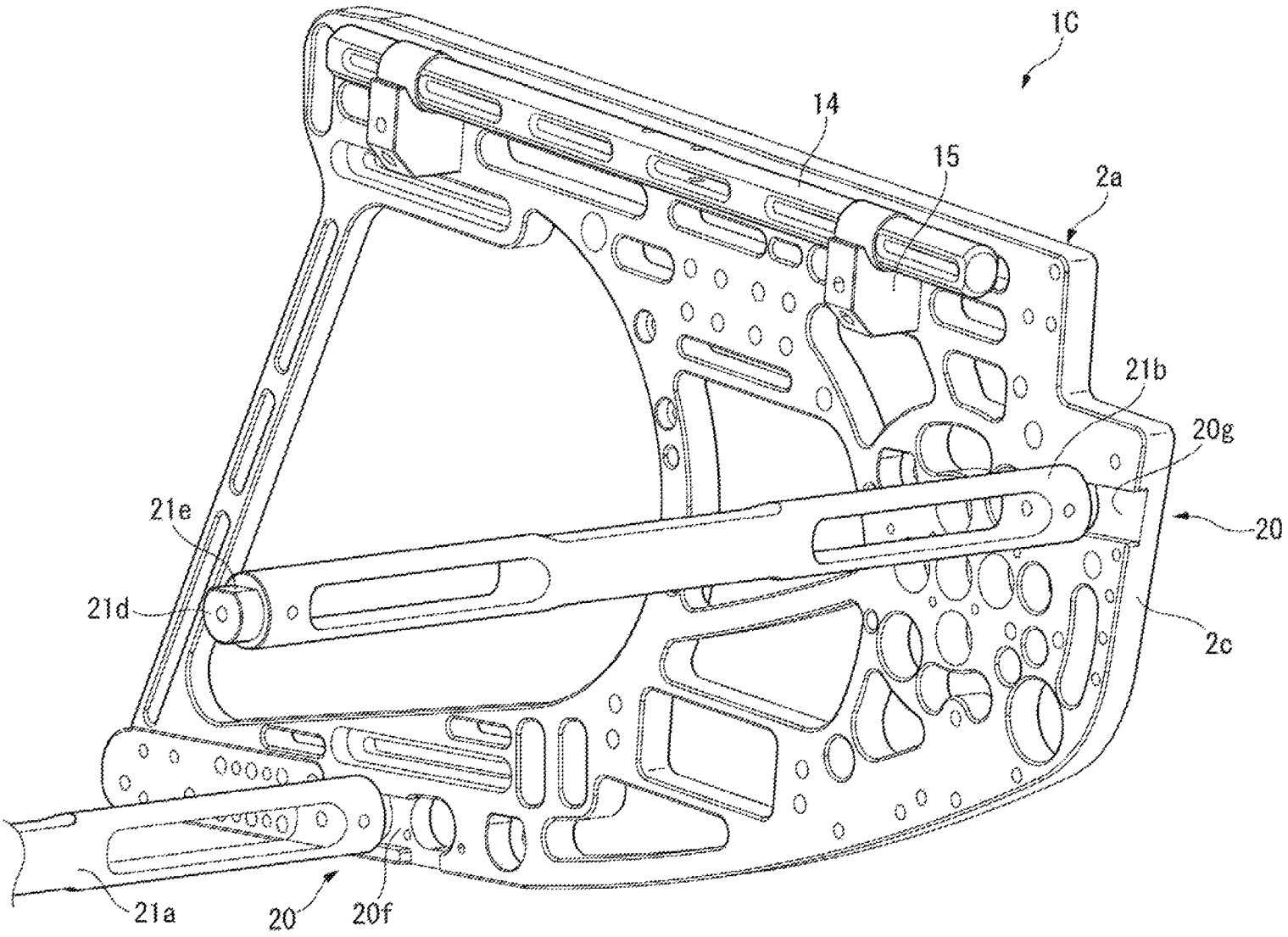
FIG. 12 is a perspective view showing a connecting member used for a second use form of the wheelchair according to the second exemplary embodiment.
Figure 13:
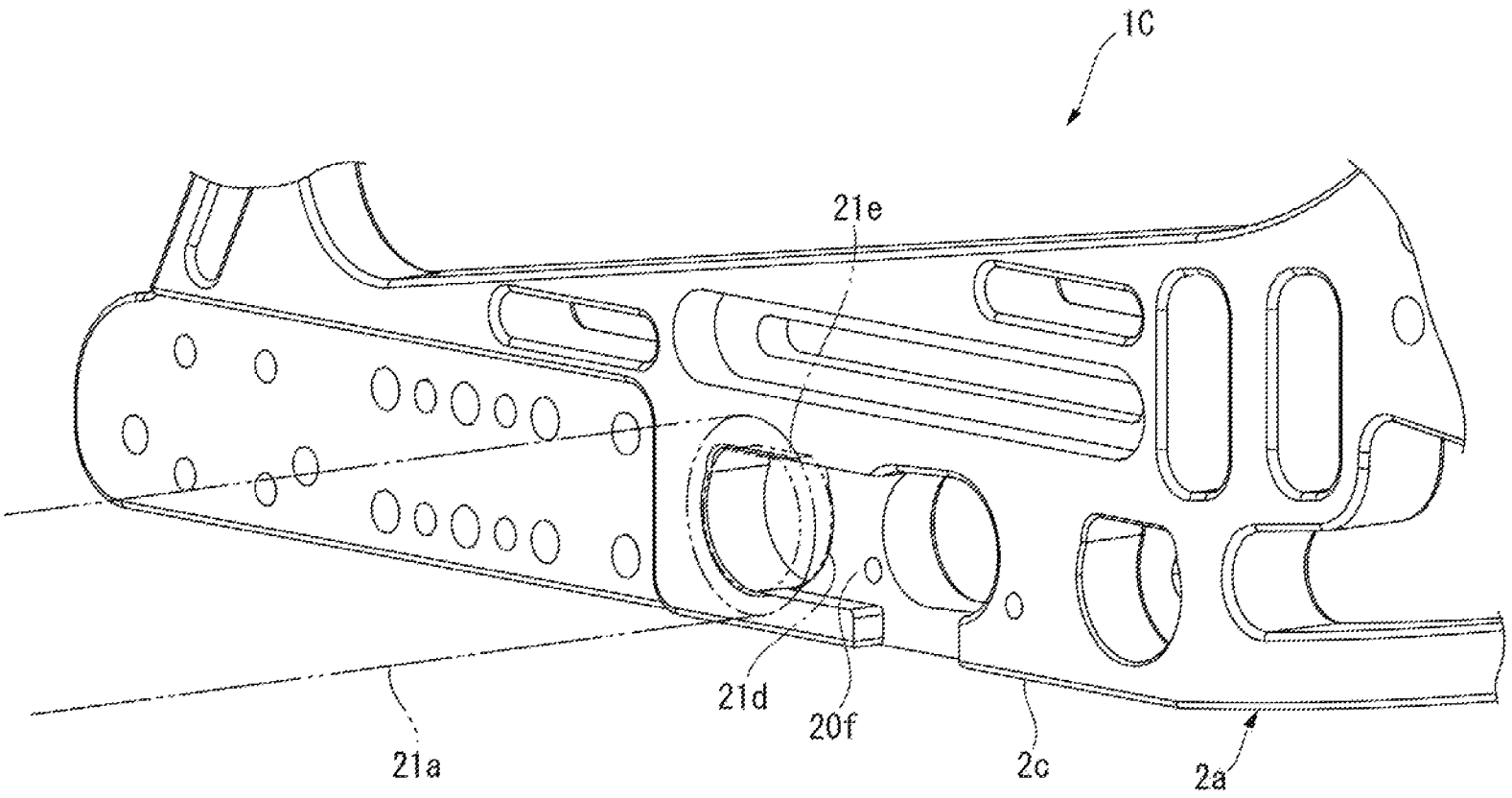
FIG. 13 is a perspective view showing a unit fixture used for the second use form of the wheelchair according to the second exemplary embodiment.
Figure 14:
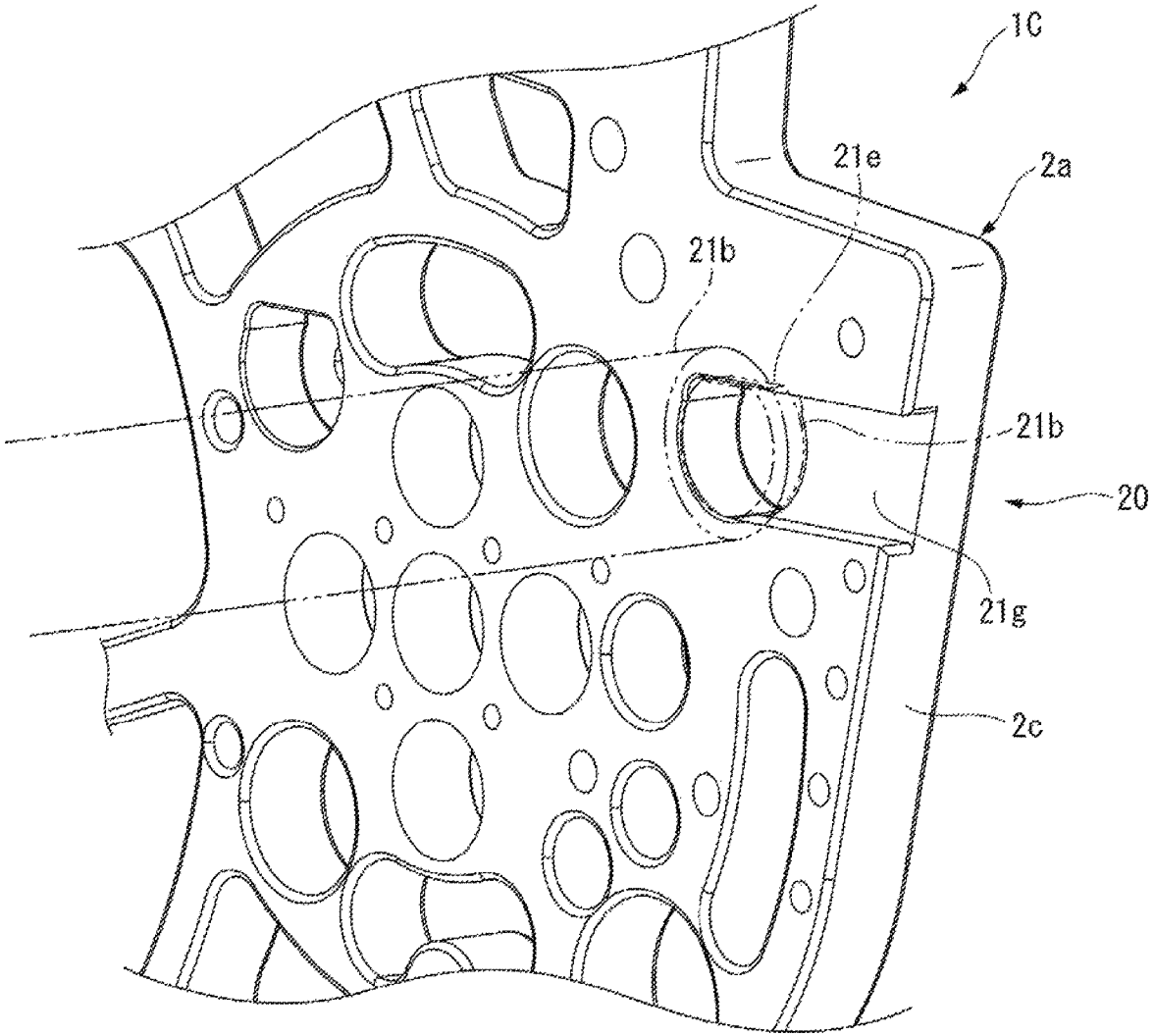
FIG. 14 is a perspective view showing another unit fixture used for the second use form of the wheelchair according to the second exemplary embodiment.

FIG. 12 is a perspective view showing a connecting member used for a second use form of the wheelchair according to the second exemplary embodiment. FIG. 13 is a perspective view showing a unit fixture used for the second use form of the wheelchair according to the second exemplary embodiment. FIG. 14 is a perspective view showing another unit fixture used for the second use form of the wheelchair according to the second exemplary embodiment.

It should be noted that although only one of the side frames, i.e., the side frame 2*a*, of a wheelchair 1B (the wheelchair in the first use form) or a wheelchair 1C (the wheelchair in the second use form) and the vicinity thereof as shown in FIGS. 9 to 14, the other side frame 2*b* and the vicinity thereof has the same configuration.

FIGS. 9 to 11 show the side frame 2*a* of the wheelchair 1B (the wheelchair in the first use form) and the vicinity thereof according to the second exemplary embodiment.

Referring to FIG. 9, the seat support 15 and an auxiliary seat support 18 are fixed to the side frame 2*a* and an end of the link member 10*b* is connected to the seat attachment 14. When the wheelchair 1B is unfolded or ready for being sat in, the seat support 15 receives the seat attachment 14 while the auxiliary seat support 18 receives the end portion of the link member 10*b*. It should be noted that the abutment portions 17, which are configured to come into contact with the opposite ends of the seat attachment 14, are omitted in the second exemplary embodiment.

Referring to FIG. 10, in order to fold the wheelchair 1B, the seat attachment 14 is separated from the seat support 15 while the link member 10*b* is separated from the auxiliary seat support 18.

Referring to FIG. 10, the auxiliary seat support 18 has a slanted upper surface, i.e., a support surface 18*a*, provided with an engagement projection 18*b* substantially at a center thereof. A surface of the end portion of the link member 10*b* being received by the auxiliary seat support 18 is provided with an engagement recess 10*c*, in which the engagement projection 18*b* is to be fitted.

As shown in FIG. 11, to get the wheelchair 1B ready for being sat in again, the end portion of the link member 10*b* is received onto the support surface 18*a* of the auxiliary seat support 18 while the engagement projection 18*b* is fitted into the engagement recess 10*c*. The fitting of the engagement projection 18*b* and the engagement recess 10*c* prevents displacement of the seat attachment 14 and accidental separation between the link member 10*b* and the auxiliary seat support 18, since the engagement projection 18*b* and the engagement recess 10*c* function as a retainer in combination.

FIGS. 12 to 14 show the side frame 2*a* of the wheelchair 1C (the wheelchair in the second use form) and the vicinity thereof according to the second exemplary embodiment.

Referring to FIG. 12, the connecting members 21*a*, 21*b*, which are configured to connect the side frame 2*a* to the opposite side frame 2*b* (not shown in FIG. 12), each have opposite ends each provided with a cylindrical fixation end 21*d* with a diameter slightly smaller than a diameter of each of the connecting members 21*a*, 21*b* as a whole. An outer circumferential surface of the fixation end 21*d* is partly provided with a flat portion 21*e*, so that the fixation end 21*d* has a substantially D-shaped cross section.

The fixation end 21*d* is fitted into the unit fixture 20 in the form of a recess, which is provided to each of opposite inner surfaces of the side frames 2*a*, 2*b*, and screwed from the outside of the side frame 2*a* or 2*b*, thereby fixing the connecting members 21*a*, 21*b* to the side frame 2*a*, 2*b*. The side frames 2*a*, 2*b* are thus fixed at a predetermined distance therebetween via the connecting members 21*a*, 21*b*.

The opposite inner surfaces of the side frames 2*a*, 2*b* are each provided with guide grooves 20*f*, 20*g* (unit fixture 20), which reach a peripheral surface 2*c* of corresponding one of the side frames 2*a*, 2*b*.

Referring to FIG. 13, the unit fixture 20 for fixing the connecting member 21*a* (lower connecting member) of the wheelchair 1C includes the guide groove 20*f*. The guide groove 20*f*, which is substantially in an L-shape extending horizontally from a position where the connecting member 21*a* is fixed and then directed downward, is continuous with a lower part of the peripheral surface 2*c* of the wheelchair 1C.

A part of the guide groove 20*f* continuous with the peripheral surface 2*c* is slightly larger than the diameter of the fixation end 21*d* so that the fixation end 21*d* can be received into the guide groove 20*f* from below irrespective of the orientation of the connecting member 21*a*.

A width (defined in a height direction of the wheelchair 1C) of the horizontal part of the guide groove 20*f* is slightly larger than a distance from the flat portion 21*e* of the fixation end 21*d* to the opposite end. The fixation end 21*d* is thus horizontally movable along the guide groove 20*f* with the flat portion 21*e* of the fixation end 21*d* being in contact with an upper (or lower) inner surface of the horizontal part of the guide groove 20*f*.

Referring to FIG. 14, the unit fixture 20 for fixing the connecting member 21*b* (rear connecting member) of the wheelchair 1C includes the guide groove 20*g*. The guide groove 20*g* extends horizontally from a position where the connecting member 21*b* is fixed to be continuous with a rear part of the peripheral surface 2*c* of the wheelchair 1C.

A height of the guide groove 20*g* is slightly larger than a distance from the flat portion 21*e* of the fixation end 21*d* to the opposite end. The fixation end 21*d* is thus horizontally movable along the guide groove 20*g* with the flat portion 21*e* of the fixation end 21*d* being in contact with an upper (or lower) inner surface of the guide groove 20*g*.

With the use of the guide grooves 20*f*, 20*g*, which form openings in the peripheral surface 2*c*, of the fixation units 20, the fixation ends 21*d* of the connecting members 21*a*, 21*b* can be introduced into the guide grooves 20*f*, 20*g* through the openings in the peripheral surface 2*c* with the side frames 2*a*, 2*b* being supported at a desired fixation distance. Additionally, the fixation ends 21*d* are provided with the flat portions 21*e*. Thus, when the flat portions 21*e* are in contact with the inside of the respective guide grooves 20*f*, 20*g*, the fixation ends 21*d* are prevented from rotation, eliminating the necessity of fixing the connecting members 21*a*, 21*b* when screwing the connecting members 21*a*, 21*b* from the outside of the side frames 2*a*, 2*b*.

Besides the above-described effects (1) to (13) of the first exemplary embodiment, the wheelchair according to the second exemplary embodiment achieves the following additional effects: prevention of displacement of the seat attachment 14 by fitting the engagement projection 18*b* in the engagement recess 10*c*; prevention of separation between the link member 10*b* and the auxiliary seat support 18; and easy attachment of the connecting members 21*a*, 21*b* with the use of the guide grooves 20*f*, 20*g*.

Further, since the connecting members 21*a*, 21*b* can be easily attached, the riding manners can be changed depending on the situation at a place to go. For instance, the wheelchair is used with excellent convenience as a compact folding wheelchair when the user frequently needs to transfer and as a highly rigid wheelchair when a travel distance is long or the ground has a lot of unevenness. Further, the wheelchair can be used not only as a sports-specific wheelchair but also as a daily wheelchair.

The invention claimed is:

1. A wheelchair comprising:

right and left side frames; and a connection unit connecting the side frames to each other, wherein the side frames each comprise a unit fixture configured to detachably fix the connection unit, the connection unit is selectable from a foldable connection unit configured to connect the right and left side frames with a distance therebetween changeable or a non-foldable connection unit configured to connect the right and left side frames with the distance therebetween kept constant, the foldable connection unit comprises:

a pair of link members crossed in an X-shape and rotatably connected by a pivot shaft at a longitudinal center thereof;

a rotary shaft provided to a lower end of each of the link members;

a shaft support detachably fixed to the unit fixture and configured to hold the rotary shaft such that the rotary shaft is rotatable; and a seat attachment provided to an upper end of each of the link members, and the side frames each comprise a seat support configured to support the seat attachment from below.

2. The wheelchair according to claim 1, wherein the foldable connection unit further comprises an auxiliary link member with a first end rotatably supported by corresponding one of the side frames and a second end rotatably connected to corresponding one of the link members.

3. A wheelchair comprising:

right and left side frames; and a connection unit connecting the side frames to each other, wherein the side frames each comprise a unit fixture configured to detachably fix the connection unit, the connection unit is selectable from a foldable connection unit configured to connect the right and left side frames with a distance therebetween changeable or a non-foldable connection unit configured to connect the right and left side frames with the distance therebetween kept constant, the non-foldable connection unit comprises a plurality of connecting members each having opposite ends configured to be detachably fixed to the unit fixture of the right side frame and the unit fixture of the left side frame, and a seat mounting member is detachably provided to each of the side frames.

* * * * *